US009068367B2

(12) United States Patent
Schuman et al.

(10) Patent No.: US 9,068,367 B2
(45) **Date of Patent: *Jun. 30, 2015**

(54) BOARDS COMPRISING AN ARRAY OF MARKS TO FACILITATE ATTACHMENT

(71) Applicant: HUBER ENGINEERED WOODS LLC, Charlotte, NC (US)

(72) Inventors: Thomas L. Schuman, Jefferson, GA (US); Katie Shea Gagnon, State College, PA (US); Robert Stephen Potter, Winston-Salem, NC (US); Roger William Latterell, Huntersville, NC (US)

(73) Assignee: HUBER ENGINEERED WOODS LLC NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/327,173

(22) Filed: Jul. 9, 2014

(65) Prior Publication Data

US 2014/0318039 A1 Oct. 30, 2014

Related U.S. Application Data

(63) Continuation of application No. 14/064,663, filed on Oct. 28, 2013, and a continuation of application No.

(Continued)

(51) Int. Cl.
*E04B 1/00* (2006.01)
*E04G 21/18* (2006.01)

(Continued)

(52) U.S. Cl.
CPC ..... *E04G 21/1891* (2013.01); *Y10T 428/24802* (2015.01); *Y10T 29/49947* (2015.01);

(Continued)

(58) Field of Classification Search
CPC ..... E04D 15/025; E04G 21/1891
USPC ..... 52/105; 33/1 G, 1 B, 563
See application file for complete search history.

(56) References Cited

U.S. PATENT DOCUMENTS 1,706,661 A 3/1929 Greenebaum
2,187,087 A 12/1937 Leary (Continued)

FOREIGN PATENT DOCUMENTS

GB 2422385 7/2006
WO 0136759 5/2001

OTHER PUBLICATIONS

Panelworld, U.S. Gypsum Teams with Matthews on Nail Marking/Logo System, Jan. 2002, pp. 93-94.

(Continued)

*Primary Examiner* — Chi Q Nguyen
(74) *Attorney, Agent, or Firm* — Gardner Groff Greenwald & Villanueva, P.C.

(57) ABSTRACT

A board includes a pattern to facilitate attachment of the board to a frame structure using fasteners. The pattern comprises a first array of first marks disposed in rows spaced apart a first predetermined distance, and a second array of second marks disposed in rows spaced apart a second predetermined distance apart, with the first and second marks being different, and with the first and second distances being different. The board may be used in a variety of construction applications, with the pattern facilitating the quick attachment of the board to the underlying frame by placing the fasteners using the first markings of the first array or the second markings of the second array.

20 Claims, 4 Drawing Sheets

Related U.S. Application Data

13/022,126, filed on Feb. 7, 2011, now Pat. No. 8,595,993, which is a continuation of application No. 10/988,914, filed on Nov. 15, 2004, now Pat. No. 7,882,661, which is a continuation of application No. 10/012,918, filed on Oct. 30, 2001, now Pat. No. 7,150,128.

(51) Int. Cl.

| | |
|---|---|
| ***E04B 5/12*** | (2006.01) |
| ***E04C 2/16*** | (2006.01) |
| ***E04F 13/16*** | (2006.01) |
| *E04D 15/02* | (2006.01) |
| *E04F 21/18* | (2006.01) |

(52) U.S. Cl.

CPC ..... *E04D15/025* (2013.01); *E04B 5/12* (2013.01); *E04C 2/16* (2013.01); *E04F 13/16* (2013.01); *E04F 21/18* (2013.01)

(56) References Cited

U.S. PATENT DOCUMENTS

| | | | |
|---|---|---|---|
| 2,270,419 | A | 1/1942 | Debo |
| 2,375,427 | A | 7/1943 | Mannino |
| 3,270,421 | A | 9/1966 | Jones |
| 3,541,745 | A | 11/1970 | Probst |
| 3,763,609 | A | 10/1973 | Probst |
| 4,397,123 | A | 8/1983 | Parker |
| 4,554,196 | A | 11/1985 | Meeker |
| 4,584,224 | A | 4/1986 | Schneller |
| 4,725,477 | A | 2/1988 | Kole et al. |
| 4,827,621 | A | 5/1989 | Borsuk |
| 4,858,402 | A | 8/1989 | Putz |
| 4,866,905 | A | 9/1989 | Bihy et al. |
| 4,870,788 | A | 10/1989 | Hassan |
| 4,924,644 | A | 5/1990 | Lewis |
| 4,927,696 | A | 5/1990 | Berg |
| 5,230,200 | A | 7/1993 | Douglas et al. |
| 5,282,317 | A | 2/1994 | Carter et al. |
| 5,632,095 | A | 5/1997 | Day |
| 5,673,489 | A | 10/1997 | Robell |
| 5,819,422 | A | 10/1998 | Schafer |
| 5,842,280 | A | 12/1998 | Robell |
| 5,887,389 | A | 3/1999 | Light |
| 5,924,213 | A | 7/1999 | Lee |
| 5,950,319 | A | 9/1999 | Harris |
| 6,012,255 | A | 1/2000 | Smid et al. |
| 6,049,987 | A | 4/2000 | Robell |
| 6,115,926 | A | 9/2000 | Robell |
| 6,119,570 | A | 9/2000 | Okonski et al. |
| 6,269,595 | B1 | 8/2001 | Blubaugh et al. |
| D462,460 | S | 9/2002 | Phillips et al. |
| 6,526,710 | B1 | 3/2003 | Killen |
| 6,539,643 | B1 | 4/2003 | Gleeson |
| 6,634,729 | B1 | 10/2003 | Schuman et al. |
| 6,880,299 | B2 | 4/2005 | Martin |
| 6,915,581 | B2 | 7/2005 | Harris |
| 6,973,759 | B2 | 12/2005 | Trpkovski |
| 7,150,128 | B2 | 12/2006 | Schuman et al. |
| 2003/0211305 | A1 | 11/2003 | Koval et al. |

OTHER PUBLICATIONS www.canwel.com, Fiberock® Brand Gypsum Fiber Underlayment web page, Feb. 11, 2002.

United States Gypsum Company, Fiberock® Brand Underlayment submittal sheet, by May 9, 2011, pp. 1-6.

United States Gypsum Company, Fiberock® Brand Underlayment Aqua Tough Installation Guide, 4 pages, by May 9, 2011.

LP OSB Sheathing Product Portfolio, Dec. 18, 2010, Louisiana-Pacific Corporation, 16 pages.

LP Product Portfolio, Jul. 2008, Louisiana-Pacific Corporation, 27 pages.

BOARDS COMPRISING AN ARRAY OF MARKS TO FACILITATE ATTACHMENT

CROSS-REFERENCE TO RELATED APPLICATIONS

This application is a continuation of U.S. application Ser. No. 14/064,663 filed on Oct. 28, 2013, which is a continuation of U.S. application Ser. No. 13/022,126 filed on Feb. 7, 2011, now U.S. Pat. No. 8,595,993, which is a continuation of U.S. application Ser. No. 10/988,914 filed on Nov. 15, 2004, now U.S. Pat. No. 7,882,661, which is a continuation of U.S. application Ser. No. 10/012,918 filed Oct. 30, 2001, now U.S. Pat. No. 7,150,128. U.S. application Ser. Nos. 10/988,914 and 10/012,918 are incorporated herein by reference in their entireties for all purposes.

BACKGROUND OF THE INVENTION

Wood boards or sheets, typically made from wood composite products like plywood or oriented strand board, are common construction materials in commercial, industrial and residential buildings. During construction, these boards are placed over and fastened to an underlying supporting frame to form the wall, roof or floor of the building.

While this method of construction is an improvement over other construction techniques, it could nonetheless be made more efficient. A principal drawback to this construction method is that when a worker places the board over the frame, the frame is no longer visible. Thus, in order to fasten or attach the board to the supporting frame it is necessary to add an additional step of measuring and marking positions on the board to align the placement of fasteners (e.g., nails or screws) so that they are directed through the board and into the underlying supporting frame. This additional measuring and marking step is problematic not only because of the time it takes, but also because measurement errors may cause the fasteners to be misaligned and fail to contact the frame. Misaligned fasteners not only decrease construction efficiency because they require that the misaligned fasteners be removed and new fasteners inserted, but also could undermine structural integrity if the worker is unaware of the error or ignores it.

To address this problem, boards have previously been manufactured with patterns on their surface to indicate the dimensions of the board and to indicate to workers using these boards the appropriate places for cutting and mounting the wood boards during construction projects. However, these patterns are typically in the form of a complicated and potentially confusing series of grids formed by a series of intersecting lines as well as other reference indicia. While these complicated patterns allow the boards to be used in a wide variety of building and construction applications they also require more time and effort by an installer to use.

Given the foregoing, there is a continuing need to develop a board comprising a pattern that may be used in many different construction applications, while also facilitating the quick attachment of the board to structural frames without the expenditure of considerable time and effort by the installer.

SUMMARY OF THE INVENTION

Briefly, the invention provides a board that includes a pattern to facilitate attachment of the board to a structure, the pattern comprising a first array of marks disposed along a first imaginary line; and a second array of marks disposed along a second imaginary line, said first and second imaginary lines being spaced a first predetermined distance apart; and a third array of marks disposed along a third imaginary line, said first and third imaginary lines being spaced a second predetermined distance apart.

The invention also provides a board for forming a structure including a pattern comprising a first array of marks disposed along a first imaginary line; a second array of marks disposed along a second imaginary line, said first and second imaginary lines being spaced a first predetermined distance apart; and a third array of marks disposed along a third imaginary line, said first and third imaginary lines being spaced a second predetermined distance apart; whereby the first array of marks, the second array of marks, and the third array of marks may be used to define points that are useful for connecting the board to the structure.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown in the drawings. In the figures, the same reference numerals are used to indicate the same elements of each of the illustrated boards.

DETAILED DESCRIPTION OF THE EXAMPLE EMBODIMENTS

As used herein, "wood" is intended to mean a cellular structure, having cell walls composed of cellulose and hemicellulose fibers bonded together by lignin polymer.

By "wood composite material" it is meant a composite material that comprises wood and one or more other additives, such as adhesives or waxes. Non-limiting examples of wood composite materials include oriented strand board ("OSB"), waferboard, particle board, chipboard, medium-density fiberboard, plywood, agfiber boards, boards that are a composite of strands and ply veneers, and boards that are a composite of agfiber and strands. As used herein, "flakes", "strands", and "wafers" are considered equivalent to one another and are used interchangeably. A non-exclusive description of wood composite materials may be found in the Supplement Volume to the Kirk-Othmer Encyclopedia of Chemical Technology, pp 765-810, 6th Edition.

All parts, percentages and ratios used herein are expressed by weight unless otherwise specified. All documents cited herein are incorporated by reference.

The following describes preferred embodiments of the present invention which provides a board or panel, preferably made from a wood or wood composite material and suitable for use in residential and commercial building construction as well as by industrial, and original equipment manufacturers. This board or panel has a pattern that makes it possible to rapidly attach the panel to a supporting frame structure as part of the construction of a roof, floor or wall by eliminating the need for additional steps of measuring and marking.

Figure 1:
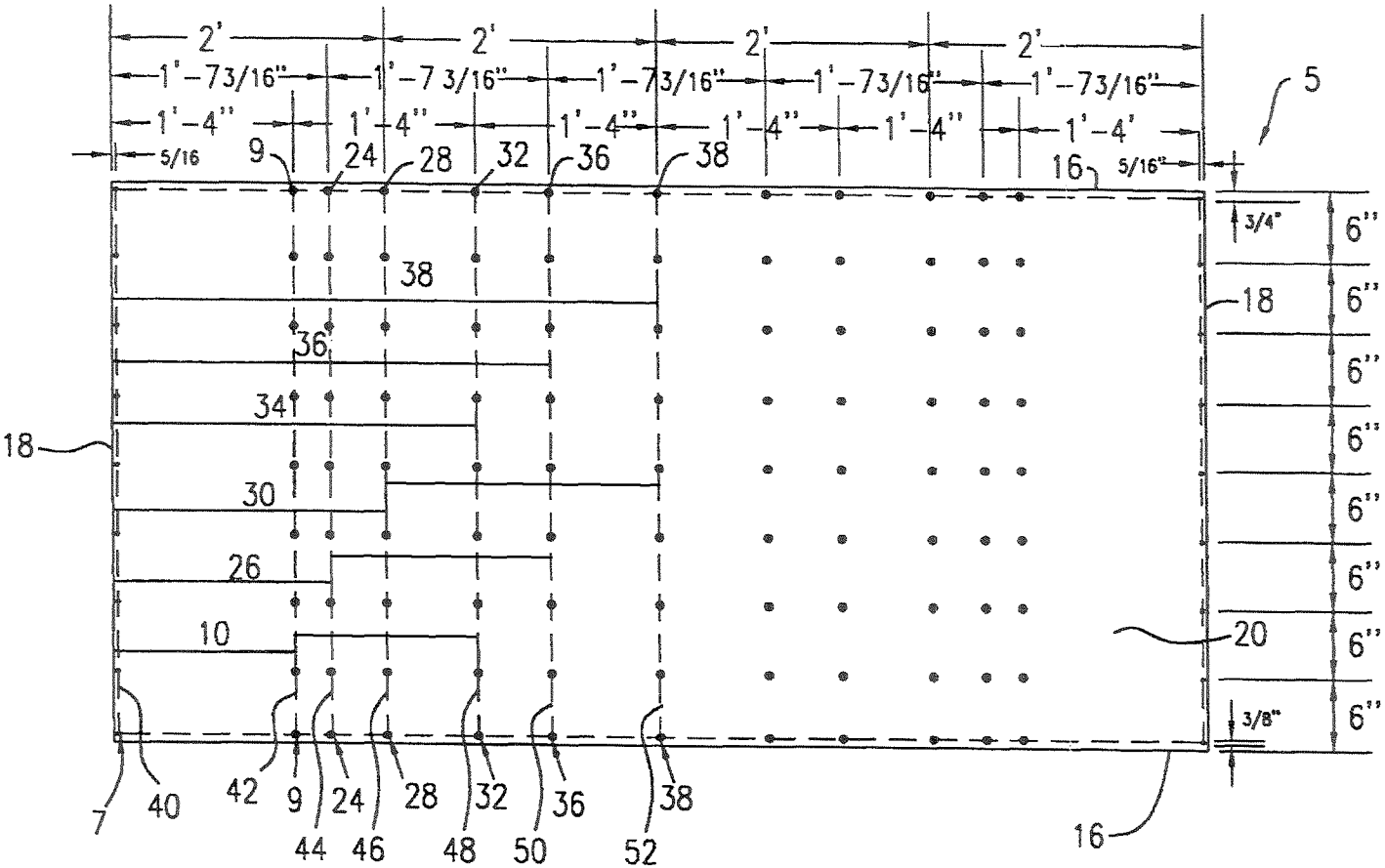
FIG. 1 is a top plan view of a board prepared according to a first embodiment of the present invention.

As shown in FIG. 1, there is a board 5 prepared according to a first embodiment of the present invention. The board 5 is in a rectangular shape defined by two parallel longitudinal edges 16 and two parallel transverse edges 18. However, boards prepared according to the present invention may be in a variety of other shapes, such as squares, triangles, etc. Nor is it necessary that edges always be parallel, rather the edges may be scalloped, have a sinusoidal form or some other form.

The board 5 may be used in a variety of different applications, but it is envisioned that the board 5 will be attached to a conventional frame structure (not shown). The conventional frame structure has a plurality of spaced vertical components, which may be spaced any distance apart from each other. These vertical components are connected at each end by horizontal frame components. The vertical components are referred to as "studs" in the case of a frame structure forming a wall, "joists" in a frame structure supporting a floor, and "rafters" for a frame structure underlying a roof.

Figure 2:
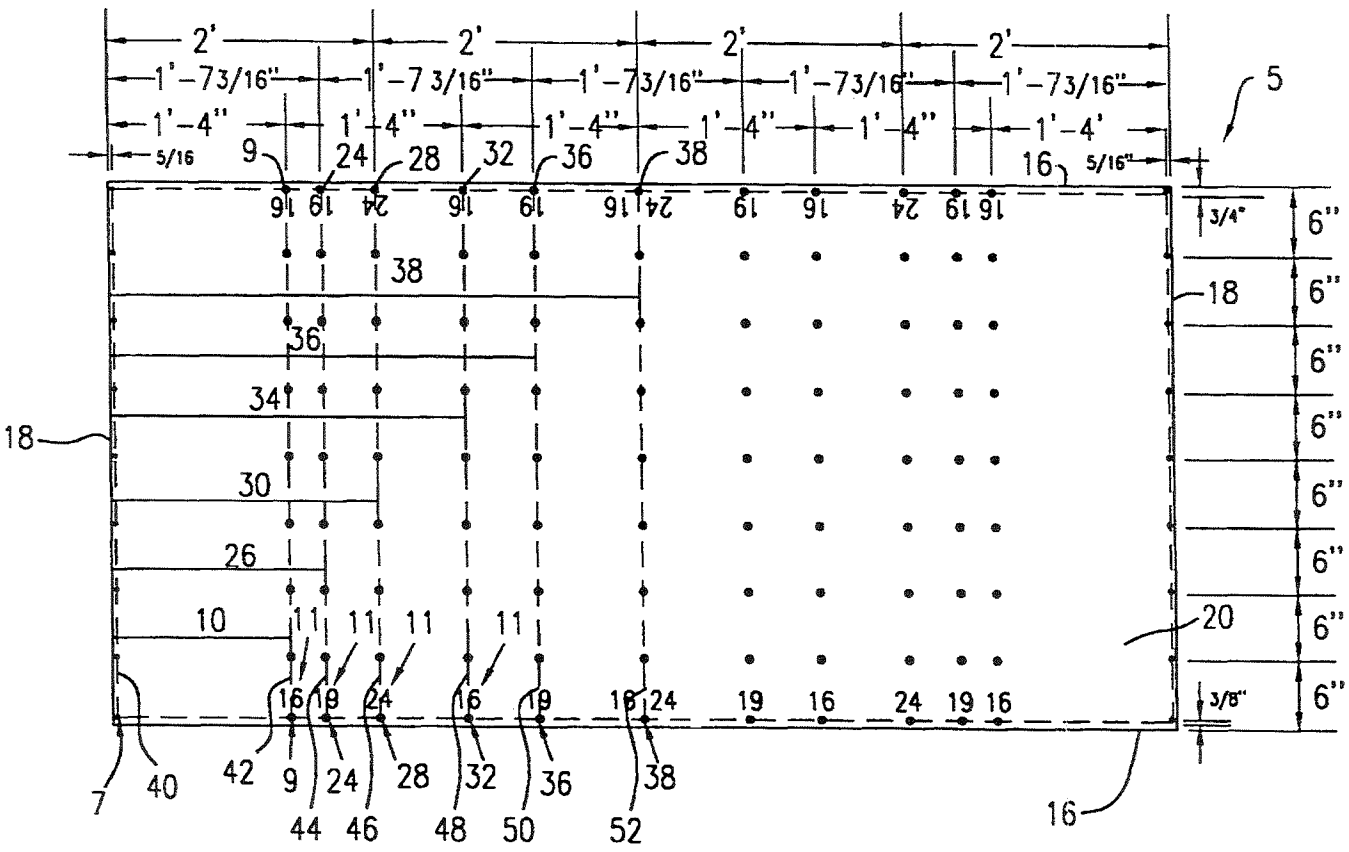
FIG. 2 is a top plan view of a board prepared according to a second embodiment of the present invention.
Figure 3:
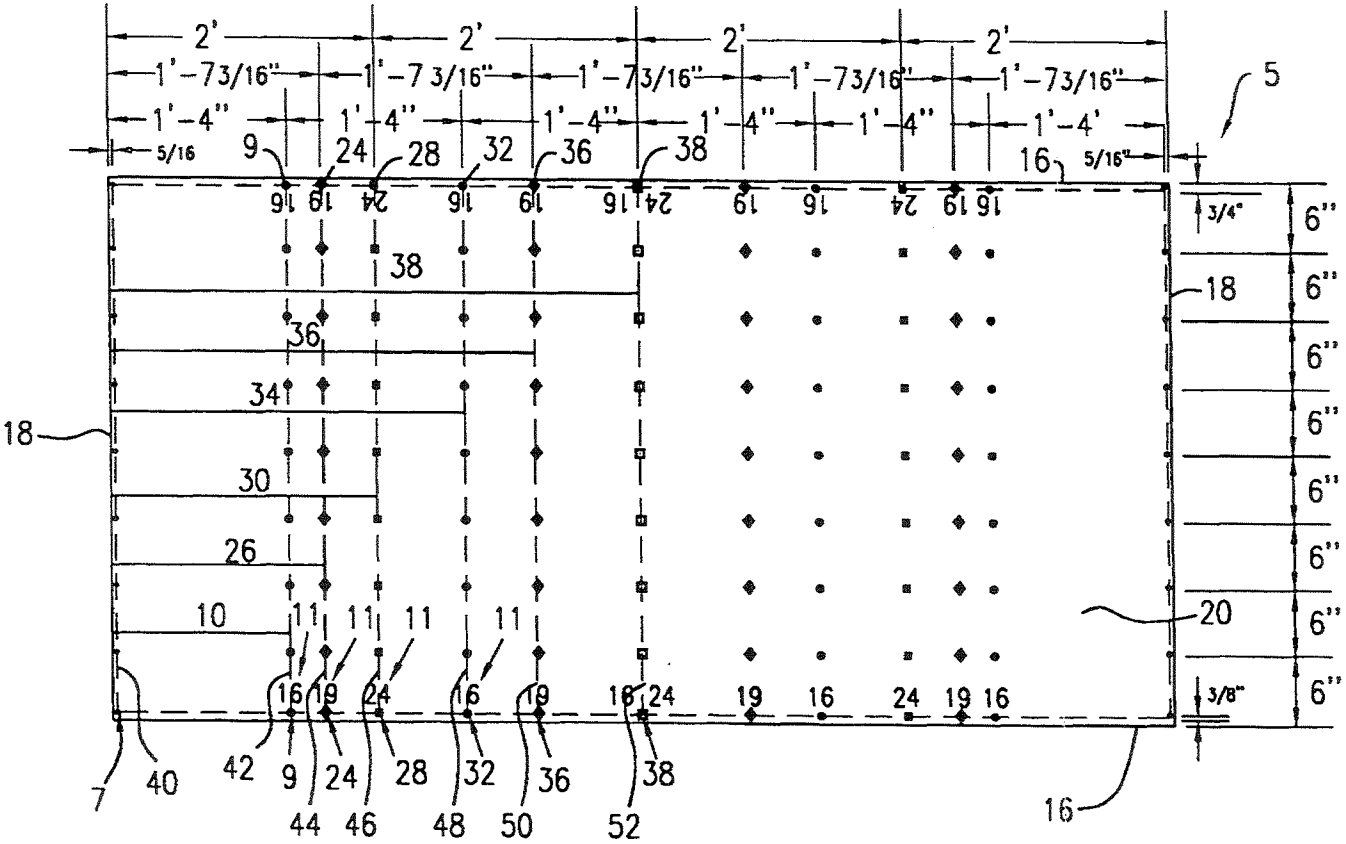
FIG. 3 is a top plan view of a board prepared according to a third embodiment of the present invention.

The board 5 includes a pattern comprising a first array of marks 7 disposed along a first imaginary line 40, and a second array of marks 9 disposed along a second imaginary line 42, said first and second imaginary lines being spaced a first predetermined distance 10 apart. (The imaginary lines illustrated in FIGS. 1-3 are shown only for reference, they are not actually marked on the board). This first predetermined distance 10 is set so that it represents the distance between the vertical components of the frame structure (not shown). Thus, these arrays function to identify locations where fasteners (not shown) can be used to attach the board 5 to the frame structure. The frame structure is typically made from wood or a wood composite. In actual use, the board 5 is placed upon the frame structure, and the fasteners inserted completely through the board 5 and into the vertical components of the underlying frame structure. A non-exclusive list of suitable fasteners include nails, screws, ring-shank nails, cemented-coated nails and staples.

Thus, the first predetermined distance 10 can be any suitable distance that corresponds to the spacing of vertical components of a frame structure. In FIGS. 1-3, the first predetermined distance 10 is shown as about 16 inches (about 40.7 cm). Although not shown in the figures, boards prepared according to the present invention may have a pattern of one-dimensional arrays each of which are separated by the same first predetermined distance 10, repeated over the entire surface of the board. (The dimensions indicated in the figure are, of course, not included or in anyway printed on the board, but are shown only for reference to illustrate the layout and arrangement of one particular pattern of arrays. Patterns of arrays having different dimensions are also acceptable.)

Rather than repeating a series of arrays each series being separated by the same distance, over the entire marking surface 22 of the board 5, it is preferred that arrays separated by different spacings be used so that the board 5 can be installed on frame structures having a variety of different vertical component spacings. In FIGS. 1-3, the pattern additionally comprises a third array of marks 24 disposed along a third imaginary line 44, the first and third imaginary lines being spaced a second predetermined distance 26 apart, a fourth array of marks 28 disposed along a fourth imaginary line 46, said first and fourth imaginary lines 40, 46 being spaced a third predetermined distance apart 30. In FIGS. 1-3, the second predetermined distance is about 19 3/16 inches (about 48.7 cm), while the third predetermined distance is about 24 inches (about 61 cm).

Additionally, this pattern in FIGS. 1-3 also includes a fifth array of marks 32 disposed along a fifth imaginary line 48, said first and fifth imaginary lines 40, 48 being spaced a fourth predetermined distance 34 apart; a sixth array of marks 37 disposed along a sixth imaginary line 50, said first and sixth imaginary lines 40, 50 being spaced a fifth predetermined distance apart 36; and a seventh array of marks 38 disposed along a seventh imaginary line 52, said first and seventh imaginary lines 40, 52 being spaced a sixth predetermined distance apart 41. These first seven arrays are found in the first half of the marking surface 22 of the board 5. The second half of the board 5 has mirror symmetry with the first half, the mirror being set upon the seventh imaginary line 52. In FIGS. 1-3, the fourth predetermined distance is about 32 inches (about 81.3 cm), while the fifth predetermined distance is about 383/8 inches (about 97.4 cm) and the sixth predetermined distance is about 48 inches (about 122 cm).

Indicia, particular alphanumeric characters such as numbers or letters, may be used to indicate the vertical component spacings represented by each of the arrays. In the preferred embodiment shown in FIGS. 2 and 3, the alphanumeric indicia are numerals 11. Thus, in FIGS. 2 and 3, the numerals shown as "16" represent the appropriate spacings for joists, rafters or studs that are separated by 16 inches. Likewise, "19" or "19.2" represent the 19 3/16 inch spacing, and "24" represents the 24 inch spacing. Thus, the board 5 may be affixed to a supporting frame by directing fasteners through the board at the locations indicated by the appropriate arrays—the appropriate arrays are those having a spacing corresponding to the vertical components of the supporting frame.

Figure 4:
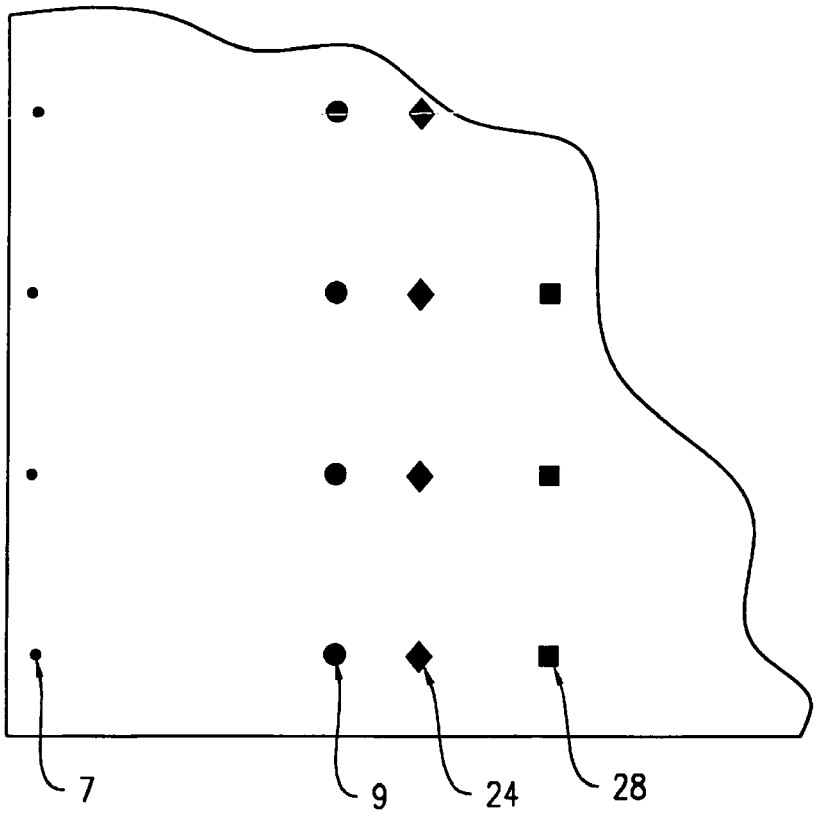
FIG. 4 is a partial top plan view of a board prepared according to the third embodiment of the present invention.

The marks on the board may be selected from several different forms, the forms include circles, dots, squares, diamonds and other forms. In the third embodiment of the present invention shown in FIGS. 3 and 4, the marks are selected from several different forms. Marks in the first array 7, the second array 9, and the fifth array 32 are all in the form of circles, while marks in the third array 24 and the sixth array 36 are both in the form of diamonds. Marks in the fourth array 28 are in the form of squares. Marks in the seventh array 38 are shown as squares with dots inside. Thus, the circles indicate a separation of 16 inches, so when the board 5 is placed over a frame structure having vertical components spaced every sixteen inches, then the circles indicate the location of the vertical components beneath the board 5. The marks shown in FIG. 3 for each of the arrays are for illustration only, different marks may be selected for each of the arrays and the list of marks mentioned above is not intended to be exhaustive of the forms the marks may take. The marks are not necessarily shown to scale.

By directing the fasteners into the board 5 along the imaginary lines defined by these markings, the board 5 may be affixed to the frame structure. In a similar fashion, the diamonds represent a 19 3/16 inch spacing between vertical components, while the squares represent a twenty four inch spacing. The dot enclosed by the square indicates that this portion of the board may be placed over either a 16 inch or a 24 inch-spaced vertical component. By having all these sets of marks, a single board may be applied to frame structures in which the vertical components are separated by 16 inches, 19 3/16 inches, or 24 inches. While it is not necessary to use marks having different forms, such a practice may facilitate the use of the presently disclosed boards.

Although not a necessary aspect of the present invention, FIGS. 1-3 all show a preferred embodiment in which the marks that comprise each of the arrays are uniformly spaced apart in the transverse direction by about 6 inches (15.25 cm).

Thus, these marks not only indicate the precise location of the underlying vertical component of the frame structure, they may also serve as "targets" to indicate the precise location that a worker should place a fastener into the board to secure the board to the vertical component of the frame. Generally, municipal or state building codes require that a minimum number of fasteners be used to affix the board to the vertical components of a frame structure in order to insure at least a minimum standard of structural integrity. Thus, the number of marks in an array may correspond to this minimum number of fasteners required by law so that by inserting a fastener at each of the marks, compliance with building code standards can be achieved. Although in a preferred embodiment the marks are uniformly spaced apart, this is not a required aspect of the present invention, and the transverse spacing of the marks may be non-uniform, as well.

In the process of constructing a roof, floor, wall or other building elements with these boards, a worker first applies the board upon the vertical components of the frame structure. When this is done, the arrays of marks corresponding to a certain vertical component spacing will be aligned with the vertical components of the structural frame. The application process may then occur in two steps: a first step in which the board is temporarily secured to the frame structure with a few nails or screws, and a second step in which a worker uses special equipment such as a high-speed fastener or nail gun to permanently attach the board to the frame structure. Alternatively, the application process may be carried out in a single step of applying the board permanently to the frame structure. Each of the arrays of marks defines an imaginary line along which fasteners are inserted into the board in order to attach the board to the frame structure. The worker may elect to insert the fasteners into the board anywhere along the imaginary lines defined by the array. In a preferred embodiment of the application process, the worker places the fasteners through the board and into the vertical component of the frame at only those locations of the board identified by a mark.

Although the board can be made of any commonly used material, it is preferred that the board be made from a wood or wood composite material. A preferred wood composite material is oriented strand board. OSB panels are derived from a starting material that is naturally occurring hard or soft woods, singularly or mixed, whether such wood is dry (having a moisture content of between 2 wt % and 12 wt %) or green (having a moisture content of between 30 wt % and 200 wt %). Typically, the raw wood starting materials, either virgin or reclaimed, are cut into strands, wafers or flakes of desired size and shape, which are well known to one of ordinary skill in the art.

After the strands are cut they are dried in an oven to a moisture content of about 2 wt % to 5 wt % and then coated with one or more polymeric thermosetting binder resins, waxes and other additives. The binder resin and the other various additives that are applied to the wood materials are referred to herein as a coating, even though the binder and additives may be in the form of small particles, such as atomized particles or solid particles, which do not form a continuous coating upon the wood material. Conventionally, the binder, wax and any other additives are applied to the wood materials by one or more spraying, blending or mixing techniques, a preferred technique is to spray the wax, resin and other additives upon the wood strands as the strands are tumbled in a drum blender.

After being coated and treated with the desired coating and treatment chemicals, these coated strands are used to form a multi-layered mat. In a conventional process for forming a multi-layered mat, the coated wood materials are spread on a conveyor belt in a series of two or more, preferably three layers. The strands are positioned on the conveyor belt as alternating layers where the "strands" in adjacent layers are oriented generally perpendicular to each other.

Various polymeric resins, preferably thermosetting resins, may be employed as binders for the wood flakes or strands. Suitable polymeric binders include isocyanate resin, urea-formaldehyde, phenol formaldehyde, melamine formaldehyde ("MUF") and the copolymers thereof. Isocyanates are the preferred binders, and preferably the isocyanates are selected from the diphenylmethane-p,p'-diisocyanate group of polymers, which have NCO-functional groups that can react with other organic groups to form polymer groups such as polyurea, —NCON—, and polyurethane, —NCOON—. 4,4-diphenyl-methane diisocyanate ("MDI") is preferred. A suitable commercial MDI product is Rubinate pMDI available from ICI Chemicals Polyurethane Group. Suitable commercial MUF binders are the LS 2358 and LS 2250 products from the Dynea corporation.

The binder concentration is preferably in the range of about 1.5 wt % to about 20 wt %, more preferably about 3 wt % to about 10 wt %. A wax additive is commonly employed to enhance the resistance of the OSB panels to moisture penetration. Preferred waxes are slack wax or an emulsion wax. The wax loading level is preferably in the range of about 0.5 to about 2.5 wt %.

After the multi-layered mats are formed according to the process discussed above, they are compressed under a hot press machine that fuses and binds together the wood materials to form consolidated OSB panels of various thickness and sizes. Preferably, the panels of the invention are pressed for 2-10 minutes at a temperature of about 175° C. to about 240° C. The resulting composite panels will have a density in the range of about 35 to about 50 pcf (as measured by ASTM standard D1037-98) and a thickness of about 0.6 cm (about ¼") to about 3.8 cm (about 1 ½"). Suitable OSB products are marketed under the name ADVANTECH®, which is available form the J.M. Huber Corporation of Edison, N.J.

After being compressed in the hot press, the array of marks are positioned on the board using any suitable marking process, such as by ink stamps, roll-coder or metal stamp. The marks may be carved on the marking surface of the board, using a laser beam, a blade or similar item. In a preferred embodiment, the marks are printed on the board by the use of ink-jet technology. An apparatus suitable for marking the boards can be assembled by integrating a device for handling the board (such as a Globe 16Q hold-down device) with a device for marking the board, such as one of the industrial ink-jet printing and coding system products made by the Matthews International Corporation. As the board enters the hold-down device, it makes contact with four steel drive rollers (coated with rubber or some other elastomer) which reduce slippage. Each of these drive rollers has a series of tension rollers installed directly above in order to flatten the panel prior to printing, which improves the accuracy with which the indicia are applied to the panel. The speed of the board is monitored with an encoder mounted on the hold-down device's drive shaft, and the ink-jet printing system triggered, in coordination with the encoder, to deposit the markings on the board at the appropriate time. By the use of this mechanical process, the ink-jet printing system can be mounted much closer to the board for enhanced printing quality, and the boards can be marked at much higher speeds.

Although the present invention has been described in detail with relation to wood materials, the presently disclosed pattern may also be used on boards composed of non-wood materials such as fiberglass composite, drywall, sheetrock, and metals.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A sheet of material for installation using fasteners, the sheet of material comprising:

a wood panel having a generally vertical leading edge;

a first array having a plurality of generally vertical rows, each row of the first array including a plurality of first individual discrete fastener markings that serve as discrete targets to provide precise locations to place the fasteners during installation, wherein the rows of the first array are generally horizontally spaced apart from each other by approximately 16 inches, wherein a first row of the first array is spaced from the leading edge by approximately 16 inches, a second row of the first array is spaced from the first row by approximately 16 inches; and a third row of the first array is spaced from the second row by approximately 16 inches; and a second array having a plurality of generally vertical rows, each row of the second array including a plurality of second individual discrete fastener markings that serve as discrete targets to provide precise locations to place the fasteners during installation, wherein the rows of the second array are generally horizontally spaced apart from each other by approximately 24 inches, wherein a first row of the second array is spaced from the leading edge by approximately 24 inches, and a second row of the second array is spaced from the first row by approximately 24 inches, wherein the first and second individual fastener markings within each row of the first and second arrays are arranged in respective substantially straight lines that are substantially parallel to the leading edge, wherein the first discrete fastener markings of the first array have a first geometric shape, the second discrete fastener markings of the second array have a second geometric shape, and the first geometric shape is different from the second geometric shape, and wherein the third row of the first array and the second row of the second array are aligned along a common generally vertical line that defines a centerline of the panel.

2. The sheet of material of claim 1, wherein the wood panel is a wood composite panel.

3. The sheet of material of claim 1, further comprising an initial row of initial fastener markings adjacent the leading edge and substantially parallel to the leading edge, wherein the initial fastener markings adjacent the leading edge have a different shape or size from the first and second fastener markings of the first and second arrays.

4. The sheet of material of claim 1, further comprising a first numerical indicia positioned adjacent at least one of the first fastener markings of at least one of the rows of the first array and a second numerical indicia positioned adjacent at least one of the second fastener markings of at least one of the rows of the second array, wherein the first numerical indicia indicates the spacing between the rows of the first array and the second numerical indicia indicates the spacing between the rows of the second array, and wherein the first numerical indicia is the numeral 16 and the second numerical indicia is the numeral 24.

5. The sheet of material of claim 1, wherein the first discrete fastener markings of the rows of the first array are equidistantly spaced apart vertically from each other by a first vertical distance and the second discrete fastener markings of the rows of the second array are equidistantly spaced apart vertically from each other by a second vertical distance, and wherein the first vertical distance and the second vertical distance are substantially equal.

6. A sheet of material for installation using fasteners, the sheet of material comprising:

a wood panel having a generally vertical leading edge;

a first array having a plurality of generally vertical rows, each row of the first array including a plurality of first individual discrete fastener markings that serve as discrete targets to provide precise locations to place the fasteners during installation, wherein the rows of the first array are generally horizontally spaced apart from each other by a first distance, wherein a first row of the first array is spaced from the leading edge by the first distance, a second row of the first array is spaced from the first row by the first distance; and a third row of the first array is spaced from the second row by the first distance; and a second array having a plurality of generally vertical rows, each row of the second array including a plurality of second individual discrete fastener markings that serve as discrete targets to provide precise locations to place the fasteners during installation, wherein the rows of the second array are generally horizontally spaced apart from each other by a second distance, wherein a first row of the second array is spaced from the leading edge by the second distance, and a second row of the second array is spaced from the first row by the second distance, wherein the first and second individual fastener markings within each row of the first and second arrays are arranged in respective substantially straight lines that are substantially parallel to the leading edge, wherein the discrete fastener markings of the first array have a first geometric shape, the discrete fastener markings of the second array have a second geometric shape, and the first geometric shape is different from the second geometric shape.

7. The sheet of material of claim 6, wherein the wood panel is a wood composite panel.

8. The sheet of material of claim 6, further comprising an initial row of initial fastener markings adjacent the leading edge and substantially parallel to the leading edge, wherein the initial fastener markings adjacent the leading edge have a different shape or size from the first and second fastener markings of the first and second arrays.

9. The sheet of material of claim 6, further comprising a first numerical indicia positioned adjacent at least one of the first fastener markings of at least one of the rows of the first array and a second numerical indicia positioned adjacent at least one of the second fastener markings of at least one of the rows of the second array, wherein the first numerical indicia indicates the spacing between the rows of the first array and the second numerical indicia indicates the spacing between the rows of the second array.

10. The sheet of material of claim 6, wherein at least one of the rows of the first array is aligned in a common line with at least one of the rows of the second array.

11. The sheet of material of claim 6, wherein the first distance is approximately 16 inches, the second distance is approximately 24 inches, and the third row of the first array and the second row of the second array are aligned along a common generally vertical line that defines a centerline of the panel.

12. The sheet of material of claim 6, wherein the first discrete fastener markings of the rows of the first array are equidistantly spaced apart vertically from each other by a first vertical distance and the second discrete fastener markings of the rows of the second array are equidistantly spaced apart vertically from each other by a second vertical distance, and wherein the first vertical distance and the second vertical distance are substantially equal.

13. A sheet of material for installation using fasteners, the sheet of material comprising:

a wood panel having a generally vertical leading edge;

a first array having a plurality of generally vertical rows, each row of the first array including a plurality of first individual discrete fastener markings that serve as discrete targets to provide precise locations to place the fasteners during installation, wherein the rows of the first array are generally horizontally spaced apart from each other by a first distance, wherein a first one of the rows of the first array is spaced from the leading edge by the first distance, a second one of the rows of the first array is spaced from the first row by the first distance; and a third one of the rows of the first array is spaced from the second row by the first distance; and a second array having a plurality of generally vertical rows, each row of the second array including a plurality of second individual discrete fastener markings that serve as discrete targets to provide precise locations to place the fasteners during installation, wherein the rows of the second array are generally horizontally spaced apart from each other by a second distance, wherein a first one of the rows of the second array is spaced from the leading edge by the second distance, and a second one of the rows of the second array is spaced from the first row by the second distance, wherein the first and second individual fastener markings within each row of the first and second arrays are arranged in respective substantially straight lines that are substantially parallel to the leading edge, wherein the first discrete fastener markings of the first array have a first geometric shape, the second discrete fastener markings of the second array have a second geometric shape, and the first geometric shape is different from the second geometric shape.

14. The sheet of material of claim 13, wherein the wood panel is a wood composite panel.

15. The sheet of material of claim 13, further comprising an initial row of initial fastener markings adjacent the leading edge and substantially parallel to the leading edge, wherein the initial fastener markings adjacent the leading edge have a different shape or size from the first and second fastener markings of the first and second arrays.

16. The sheet of material of claim 13, further comprising a first numerical indicia positioned adjacent at least one of the fastener markings of at least one of the rows of the first array and a second numerical indicia positioned adjacent at least one of the fastener markings of at least one of the rows of the second array, wherein the first numerical indicia indicates the spacing between the rows of the first array and the second numerical indicia indicates the spacing between the rows of the second array.

17. The sheet of material of claim 13, wherein at least one of the rows of the first array is aligned in a common line with at least one of the rows of the second array.

18. The sheet of material of claim 13, wherein the first distance is approximately 16 inches, the second distance is approximately 24 inches, and the third row of the first array and the second row of the second array are aligned along a common generally vertical line that defines a centerline of the panel.

19. The sheet of material of claim 13, wherein the wood panel has two generally parallel and horizontal longitudinal edges and two generally parallel and vertical transverse edges, wherein an upper one of the longitudinal edges defines a top edge defining an about 8-foot length of the panel and one of the transverse edges defines the leading edge and defines an about 4-foot width of the panel such that the leading edge is shorter than the top edge.

20. The sheet of material of claim 13, wherein the first discrete fastener markings of the rows of the first array are equidistantly spaced apart vertically from each other by a first vertical distance and the second discrete fastener markings of the rows of the second array are equidistantly spaced apart vertically from each other by a second vertical distance, and wherein the first vertical distance and the second vertical distance are substantially equal.

* * * * *